United States Patent [19]

Tschuk

[11] Patent Number: 4,891,558

[45] Date of Patent: Jan. 2, 1990

[54] ADAPTER FOR GAS DISCHARGE LAMPS AND/OR LOW VOLTAGE LAMPS

[75] Inventor: Robert Tschuk, Aschaffenburg, Fed. Rep. of Germany

[73] Assignee: May & Christe GmbH Transformatorenwerke, Bundesrepublik, Fed. Rep. of Germany

[21] Appl. No.: 147,096

[22] Filed: Jan. 20, 1988

Related U.S. Application Data

[63] Continuation of Ser. No. 678,526, Dec. 5, 1984, abandoned.

[30] Foreign Application Priority Data

Dec. 5, 1983 [DE] Fed. Rep. of Germany ..... 3343914

[51] Int. Cl.[4] ..... H01J 17/34

[52] U.S. Cl. ..... 315/62; 315/58; 336/83; 336/229

[58] Field of Search ..... 315/56, 57, 58, 59, 315/62, 123, 225, 290, 333; 336/83, 229, 234

[56] References Cited

U.S. PATENT DOCUMENTS

| | | | |
|---|---|---|---|
| 466,937 | 1/1892 | Pfannkuche | 336/216 |
| 3,116,437 | 12/1963 | Harvey | 315/123 |
| 3,551,736 | 12/1970 | Doehner | 315/100 |
| 4,138,783 | 2/1979 | Portier | 336/83 |
| 4,255,494 | 3/1981 | Reen et al. | 336/234 |
| 4,443,778 | 4/1984 | Mewissen | 315/57 |

FOREIGN PATENT DOCUMENTS

| | | |
|---|---|---|
| 236855 | 7/1911 | Fed. Rep. of Germany . |
| 3110427A1 | 11/1982 | Fed. Rep. of Germany . |
| 3227382A1 | 2/1983 | Fed. Rep. of Germany . |

*Primary Examiner*—Benedict V. Safourek
*Assistant Examiner*—T. Salindong
*Attorney, Agent, or Firm*—Sughrue, Mion, Zinn, Macpeak & Seas

[57] ABSTRACT

An adapter for gas discharge lamps has a housing comprising a socket for connection to the mains and a holder for the gas discharge lamp or low voltage lamp, wherein the series reactor, choke, transformer and/or transmitter with coil and magnetic circuit are arranged to surround the holder for the gas discharge lamp in the housing. To provide an adapter in compact form with small dimensions and low weight which can be simply made, the coil is wound as a circular toroidal coil or a polygon toroidal coil around the longitudinal axis of the adapter, while the magnetic circuit is made to surround the circular toroidal coil or the polygon toroidal coil on all sides and form locked on the exteriors of said coil.

14 Claims, 4 Drawing Sheets

ADAPTER FOR GAS DISCHARGE LAMPS AND/OR LOW VOLTAGE LAMPS

Figure 1:
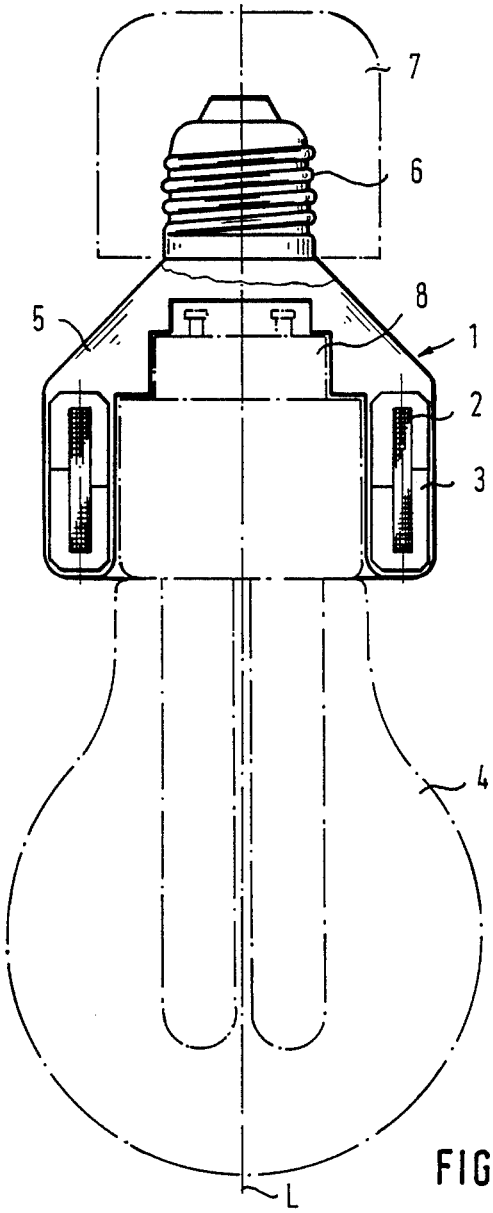

This is a continuation of application Ser. No. 678,526 filed Dec. 5, 1984 now abandoned.

The invention concerns an adapter for gas discharge lamps and/or low voltage lamps, comprising a housing with a socket for connection to a mains holder and a holder for the gas discharge lamp and/or the low voltage lamp, wherein the series reactor, choke, transformer and/or transmitter with coils and a magnetic circuit are disposed in said housing surrounding the holder for the gas discharge lamp and/or the low voltage lamp.

Such an adapter for low voltage lamps is known e.g. from U.S. Pat. No. 4,443,778 to Mewissen. The toroidal core transformer provided there is arranged to surround the holder for the low voltage lamp rotation symmetrically.

From German Pat. No. 235,855 to Valeri an adapter with transformer for electric bulbs has become known in which the transformer is designed as a transformer of the shell type, whose main core is disposed between the socket and the holder and connects the common terminals of the primary and secondary winding connected in an economizing circuit in electrically conductive manner.

A toroidal core-transformer-transmitter-choke has become known, without special indication of the purpose for which it is used and installed, from published German Application No. DE-A-3 110 427. Toroidal core transformers are costly and disadvantageous in production, and the design of a toroidal core choke for current limitation in gas discharge lamps has the drawback that the magnetic flow must be driven through a relatively small iron cross-section over a long path length. This results in relatively large dimensions and a correspondingly heavy weight of the choke so that the toroidal core choke is not usable for the design of an adapter of the type named above.

The invention is based on the object of creating an adapter of the type above, especially for energy-saving compact fluorescent lamps as the alternative to incandescent lamps, which always require a series reactor and thus cannot be fitted with an incandescent lamp socket E27, which on the one hand can be screwed into the widespread incandescent lamp holders and on the other hand contains the holder for the compact fluorescent lamps of the corresponding form, and which can be manufactured in a compact form with small dimensions and low weight by simple means.

This object is solved according to the invention by the coils being wound as toroidal coils around the longitudinal axis of the adapter, and the magnetic circuit formed to embrace the toroidal coils on all sides and form-locking on the exteriors of the coils.

Using such a design an adapter is made available in compact form with which energy-saving fluorescent lamps as well as low votage lamps can be operated by simple means from the mains in that the adapter is screwed in or inserted in the holder used for low voltage lamps, incandescent lamps etc. and at once a compact fluorescent lamp or low voltage lamp is inserted instead of the incandescent lamp and can then be used.

Advantageously the coil is designed as a circular toroidal coil and the magnetic circuit is formed by the laminations superimposed on each other in the winding direction of the coil, which are involuted in form and superimposed to be form locked while forming a closed ring.

The magnetic circuit can also be formed by planar laminations superimposed on each other in the winding direction of the coil in planes which are radial to the longitudinal axis of the adapter and diverge in stellar pattern. The latter embodiment leads to a particularly great simplification of production.

The sheet laminations are expediently minimal waste stamped parts having a U and/or L-shaped cross-section or with cross-sections such as are known from transformer and choke production.

An alternative advantageous design of the adapter with coil designed as a circular toroidal coil comprises the fact that the legs parallel to the coil axis of the magnetic circuit are formed by circular sheet rings which are layered perpendicularly to the coil axis in toroidal core form on the interior and exterior of the coil, wherein the manufacture is effected so that the magnetic flow extends in the magnetically privileged direction. The sheet rings are either wound as toroidal cores or as individual parts with respectively a butt joint.

For the magnetic yoke of this core form, expediently either the yoke rings closing the magnetic circuit are formed on the top and bottom of the coil by plate-shaped sheet ring cups which are superimposed or they are formed by involute laminations superimposed in the winding direction of the coil having I, U or L-shaped cross-section.

Using the design of the coil as a toroidal coil and the associated designs for the magnetic circuit the minimal dimensions are obtained and thus the minimal weight of the adapter, whereby in this rotation symmetrical embodiment, a space filling factor of almost 1 is given.

For the further simplification of production, it is advantageous to design the coil as a polygon toroidal coil, and the magnetic circuit consists of individual laminated core packets which surround the straight portions of the polygon toroidal coil on all sides with form locking, which contact each other or almost contact each other on an inscribed circle.

Thereby the core packets can consist expediently of sheet laminations superimposed on each other to be form locked in the winding direction of the coil with combined U, L or I-shaped cross-sections, or the core packets can consist of lamination packets superimposed on each other to be form locked transversely to the winding direction of the coil.

Alternatively the magnetic circuit can advantageously be designed so that the core packets consist of lamination packets superimposed on each other to be form locked transversly to the winding direction of the coil, combined with planar sheet laminations superimposed on each other to be form locked in the winding direction of the coil, having U,L or I-shaped cross-sections.

The inner walls, surrounding the lamp socket, of the adapter are expediently adapted to the form of the gas discharge or low voltage lamp socket, i.e. they may be triangular, rectangular or square.

It is advantageous when every straight portion of the polygon toroidal coil is enclosed by a core packet.

In one expedient embodiment, however, it is possible for only every second straight portion of the polygon toroidal coil to be surrounded by a core packet. This is more advisable when the polygon toroidal coil is designed with alternate long and short straight portions. With rectangular lamp sockets this design provides the possibility, in connection with a rectangular polygon toroidal coil, by enclosing only the long straight portions of the polygon toroidal coil by one core packet respectively, of achieving a centre-point symmetrical external basic form of the adapter.

The outer peripheral surfaces of the adapter are expediently of equal width or alternately of varying width and correspond to the number of the straight portions and optionally of the connecting curves of the polygon toroidal coil.

In the case of an adapter with integrated transformer, the primary and secondary winding of the transformer may be arranged as toroidal coils on top of or adjacent to each other. Between the primary and the secondary windings, especially in the case of toroidal coils arranged adjacently in the longitudinal direction of the adapter, it is advantageous to arrange stray field packages to form a stray field transformer or a stray field economizing transformer.

To obtain compensation, the winding of a condenser can be arranged by simple and space-saving means on the inner or outer peripheral wall surface of the adapter.

With an adapter using integrated choke it is expedient to arrange air inserts for the adjustment of the inductivity of the choke on reflection points of the magnetic circuit.

With an adapter having an integrated transmitter the magnetic circuit can also be formed preferably of symmetrical shells made of pressed powdered iron core or of sintered ferrite core so as to surround the toroidal coils in form-locking manner.

The housing of the adapter is expediently a two-part plastic housing in one part of which the lamp holder is disposed in the standard design.

Further the series reactor, the choke, the transformer and/or the transmitter and optionally the angle of a condenser are advantageously cast with a casting substance. This provides not only better heat abduction, but also sounds are largely avoided or suppressed. The winding of the condenser does not have to be specially cast before installation.

Lastly it is expedient to arrange a temperature fuse in a lead to the adapter socket.

Figure 2:
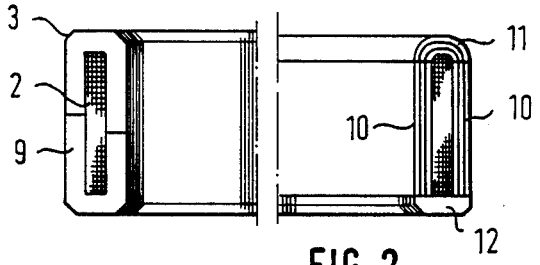
Figure 3:
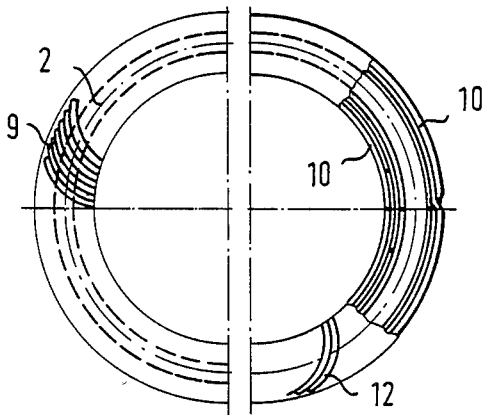
Figure 4:
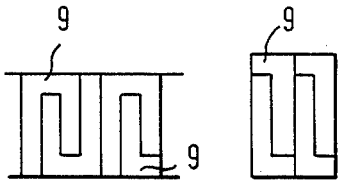
Figure 5:
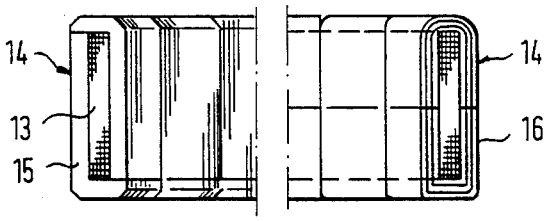
Figure 6:
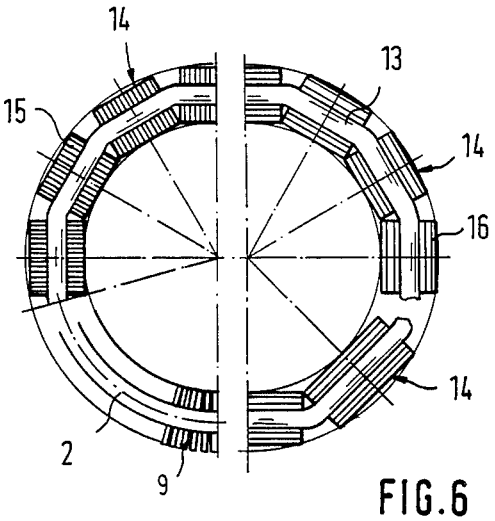
Figure 7:
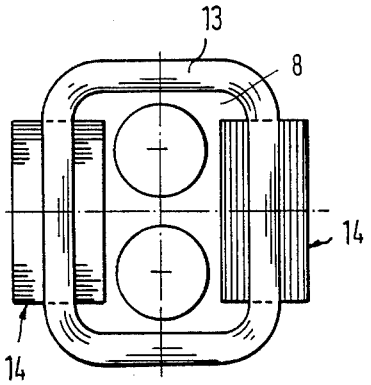
Figure 8:
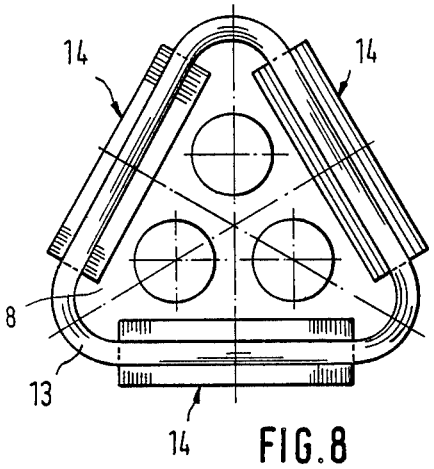
Figure 9:
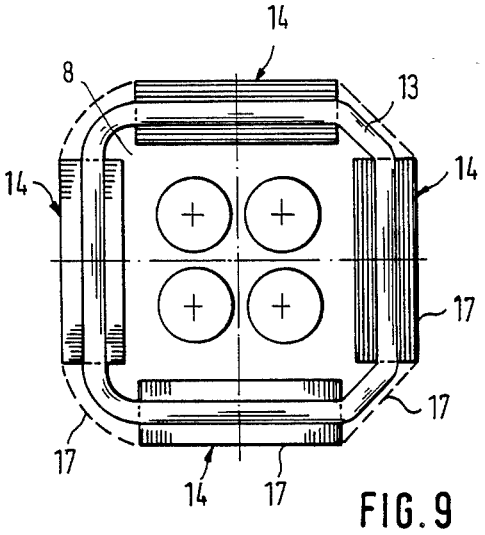

The invention is further explained below by embodiments and on the basis of the drawings by examples of adapters for gas discharge lamps with series reactor and/or choke. The drawings show:

FIG. 1: a schematic side view, partially in section, of an adapter for a gas discharge lamp with inserted compact fluorescent lamp;

FIG. 2: a choke for an adapter as in FIG. 1 in two embodiments, with toroidal coil in sectional view;

FIG. 3: a view from below, partially in section, of the choke in FIG. 2;

FIG. 4: examples of two stamped no-waste sheet laminations with U and L-shaped cross-section;

FIG. 5: side view of a choke for the inventive adapter with polygon toroidal coil in two embodiments;

FIG. 6: a plan view of the choke in FIG. 5 in cross-section;

FIG. 7: a plan view of a choke in section, surrounded by a rectangular gas discharge lamp holder;

FIG. 8: a plan view as in FIG. 7 but for a triangular gas discharge lamp holder and FIG. 9: a plan view as in FIG. 7, but for a square gas discharge lamp holder.

FIG. 1 shows a schematic side view, partially sectioned, of an embodiment of an inventive adapter 1 with toroidal coil 2 and the magnetic circuit 3 embracing in form locked manner the toroidal coil. A fluorescent lamp 4 of compact design similar to an incandescent lamp which is inserted in the adapter 1 with rotation symmetrical lamp bulb is inserted via a four-pin socket GX15D17d and connected. A housing 5 of the adapter 1 has a socket 6 for connection to a mains holder 7 and a holder for the gas discharge lamp (in this case the necessary rotary snap holder for a socket 8, type GX15D-17).

The toroidal coil 2 is wound around the longitudinal axis L of the adapter, and the magnetic circuit 3 surrounds the toroidal coil 2 on all sides to be form locked around the outer sides of the coil. The toroidal coil 2 and magnetic circuit 3 are disposed surrounding the holder rotation symmetrically in the housing 5.

In FIG. 2 and 3 embodiments are shown of a choke for the inventive adapter 1 with toroidal coil 2 schematically. The lefthand sides of FIG. 2 and 3 show a magnetic circut 3 with sheet laminations 9 superimposed in the winding direction of the toroidal coil 2 and having a U-shaped cross-section which, as can be seen in FIG. 3 clearly, as involuted in shape and form locked so as to form a closed ring resting on each other. The laminations 9 can for example be no-waste stamped parts with U and/or L-shaped cross-section, as shown in FIG. 4, or they may have cross-sections as used in transformer design.

In the embodiment shown in the righthand half of FIG. 2 and 3 the legs or yoke legs parallel to the coil axis are formed by circular sheet rings 11 layered perpendicularly to the coil axis as toroidal core on the inside and the outside of the coil. These circular yoke legs can be designed either as a wound toroidal core or as individual parts with respectively a butt joint. The manufacture is effected so that the magnetic flow extends in the magnetically preferential direction.

The yoke rings which close the magnetic circuit on the coil's top and bottom are formed either by disk-shaped superimposed sheet ring cups 11 as in FIG. 2 (top right) or they are formed by involuted sheet laminations 12 superimposed on each other in the winding direction of the toroidal coil with e.g. an I-shaped cross-section as shown in FIG. 2 (bottom right). These stamped sheet laminations 11 can also be U or L-shaped.

The design described above of the magnetic circuit 3 in combination with the toroidal coil 2 provides the minimal dimensions and thus the minimal weight for the choke, since with this rotation symmetrical design for the involuted superimposed stamped parts or for the toroidal core shaped yoke legs, a space filling factor of almost 100% is attained.

Simplification of production results when the magnetic circuit 3 is formed around a toroidal coil 2 as shown in FIG. 6 (bottom left) by planar laminations 9 superimposed in the winding direction of the toroidal coil in planes radial to the longitudinal axis of the adapter 1, i.e. by stellar-shaped sheet laminations 9.

FIG. 5 and 6, with the exception of the III quadrant in FIG. 6 show a choke with toroidal coil designed as a polygon toroidal coil 13. Here the magnetic circuit consists of individual laminated core packets 14 surrounding on all sides the straight portions of the polygon toroidal coil to be form locked, while said packets 14 contact each other or almost contact each other on an inner circuit. The core packets can be made of planar sheet laminations 15 form locked on each other in the winding direction of the polygon toroidal coil 13 with combined U,L or I-shaped cross-sections) (cf. also the lefthand side of FIG. 6). The core packets 14 can also consist, as shown in FIG. 5 and 6 on the right respectively, of lamination packets 16 superimposed to be form locked transversely to the winding direction of the polygon toroidal coil.

Lastly there is the possibility that the core packets 14 may consist of lamination packets which are superimposed to be form locked transversely to the winding direction of the polygon toroidal coil 13 combined with planar sheet laminations superimposed to be form locked in the winding direction of the coil with U, L or I-shaped cross-sections. The toroidal coil 2 can be regarded as a limiting case of a polygon toroidal coil 13 with a very high angle number, whereby the core packets 14 then have only the length equalling the thickness of the laminations 9, as shown in FIG. 6 at bottom left.

FIG. 7 to 9 show various polygon toroidal coils 13 which correspond to the different forms of the gas discharge lamp socket 8, such as triangular, rectangular, square or octagonal. The inner walls surrounding the lamp socket 8 of the adapter are adapted to the shape of the lamp socket 8. Every straight portion of the polygon toroidal coil 13, with the exception of the rectangular coil in FIG. 7 and the octangular coil in FIG. 9 on the right is surrounded by core packet 14. With the rectangular polygon toroidal coil 13 in FIG. 7 and the octagonal polygon toroidal coil 13 in FIG. 9 on the right, every second straight portion of the polygon toroidal core 13 is surrounded by a core packet 14. This means for the rectangular lamp holder 8 in FIG. 7 that two core packets are arranged only on the long straight portions of the polygon toroidal coil 13, whereby the adapter 1, despite the non-point symmetrical lamp holder 8, is given a symmetrical external basic form. In the unevenly octanglar polygon toroidal coil 13 in FIG. 9 on the right, the short straight portions or connecting arcs are free from core packets. The number of the outer peripheral surfaces 17 of alternately varying width is eight.

The adapter 1 can also only accept partial inductivity so that in existing lights with series reactors already installed, lamps of smaller power but greater light yield can also be used by employing adapter 1 with a lamp socket E 27. In the design of the adapter 1 which uses an integrated transformer for low voltage lamps, the primary and secondary windings of the transformer can be arranged as toroidal coils in the manner known i.e superimposed or adjacent. Especially the arrangement of the primary and secondary windings adjacent to each other in the longitudinal direction of the adapter makes possible the insertion of stray field packets to form a stray field transformer or stray field economizing transformer, so that the adapter can also be used in this form as a series reactor for the operation of gas discharge lamps. To make compensation possible, on the inner or outer peripheral wall surface of adapter 1, the winding of a condenser can be arranged.

If adapter 1 is designed with an integrated choke it is expedient to arrange air gap inserts for the adjustment of the inductivity on the reflection poinst of the magnetic circit 3. If the adapter is designed with an integrated transmitter, the magnetic circuit 3 should expediently be made of pressed powdered iron cores or of sintered ferrite cores which are disposed to be form locked, surrounding the toroidal coil 2 or the polygon toroidal coil 13, whereby preferably symmetrical shells are used.

Housing 5 is advantageously designed as a two-part plastic housing in one part of which the lamp holder is provided in standard design. Lastly for better heat abduction and the reduction or avoidance of sounds, the series reactor, choke, transformer or transmitter, optionally including the condenser winding, are impregnated with casting substance in the housing.

A temperature fuse can also be arranged in a lead to the adapter socket 6.

I claim:

1. An adapter for gas discharge lamps comprising:

a housing having a longitudinal axis with a socket for connection to a Mains holder and a holder for said gas discharge lamp aligned on said longitudinal axis in which a magnetic circuit with a coil connected as a series reactor is arranged in said housing surrounding the holder for the gas discharge lamp, the coil being wound in a circumferential direction as a toroidal coil around said longitudinal axis of the adaptor, wherein the coil is a polygon toroidal coil having a series of straight portions and the magnetic circuit consists of individual laminated core packets which surround the straight portions of the polygon toroidal coil on all sides and are secured thereon with said packets being disposed in close proximity to each other within the coil.

2. Adapter as claimed in claim 1, wherein the core packets consist of planar sheet laminations superimposed to be form locked in the circumferential direction of the coil having combined U, L or I-shaped cross-sections.

3. Adapter as claimed in claim 1, wherein the core packets consist of lamination packets superimposed to be form locked transversely to the circumferential direction of the coil.

4. Adapter as claimed in claim 1, wherein the core packets consist of lamination packets superimposed to be form locked transversely to the circumferential direction of the coil combined with planar sheet laminations superimposed to be form locked in the circumferential direction of the coil having U, L or I-shaped cross-sections.

5. An adapter as set forth in claim 1, wherein said packets make contact with each other within the coil.

6. An adapter as claimed in claim 1, wherein the magnetic circuit is made of symmetrical shells made of pressed, powdered iron core or of sintered ferrite core enclosing the toroidal coil in form-locked manner.

7. An adapter as claimed in claim 1, wherein the magnetic circuit with the coil is molded in the housing with molding compound.

8. Adapter as claimed in claim 1, wherein the adapter is provided with a plurality of straight side walls surrounding the lamp socket.

9. Adapter as claimed in claim 8, wherein each of the straight portions of the polygon toroidal coil is enclosed by a core packet.

10. Adapter as claimed in claim 8, wherein alternating straight portions of the polygon toroidal coil are each enclosed by a core packet.

11. Adapter as claimed in claim 10, wherein the adapter is provided with a plurality of outer peripheral surfaces complimentary to the portions of the polygonal toroidal coil.

12. An adapter for gas discharge lamps comprising:

a housing having a longitudinal axis with a socket for connection to a Mains holder and a holder for said gas discharge lamp aligned on said longitudinal axis in which a magnetic circuit with a coil connected as a series reactor is arranged in said housing surrounding the holder for the gas discharge lamp, the coil being wound in a circumferential direction as a circular toroidal coil around said longitudinal axis of the adaptor; and the magnetic circuit comprising a hollow sheet laminated cylindrical ring surrounding and enclosing the toroidal coil on all sides and being form-locked on said sides, the closed cylindrical ring forming the magnetic circut being formed by sheet laminations superimposed in the circumferential direction of said coil, said sheet laminations being involuted in form and form-locked on each other forming a closed ring.

13. An adapter as claimed in claim 12, wherein the sheet laminations are no-waste stamped parts with U and/or L-shaped cross-sections.

14. An adapter for gas discharge lamps comprising:

a housing having a longitudinal axis with a socket for connection to a Mains holder and a holder for said gas discharge lamp aligned on said longitudinal axis in which a magnetic circuit with a coil connected as a series reactor is arranged in said housing surrounding the holder for the gas discharge lamp, the coil being wound in a circumferential direction as a circular toroidal coil around said longitudinal axis of the adaptor; and the magnetic circuit comprising a hollow sheet laminated closed cylindrical ring surrounding and enclosing the toroidal coil on all sides and being secured on said coil, said closed cylindrical ring including yoke rings having legs parallel to the longitudinal axis, said yoke rings being formed by involuted sheet laminations layered perpendicular to the longitudinal axis and superimposed in the circumferential direction of the coil with said sheet laminations having I, U or L-shaped cross-sections.

* * * * *